US005787736A

United States Patent [19]

Ling

[11] Patent Number: 5,787,736

[45] Date of Patent: Aug. 4, 1998

[54] RESETTABLE COMBINATION CODED U-SHACKLE LOCK

[76] Inventor: Chong-Kuan Ling, P.O. Box 96-156, Taipei, Taiwan

[21] Appl. No.: 897,039

[22] Filed: Jul. 18, 1997

[51] Int. Cl.[6] ..... E05B 37/02

[52] U.S. Cl. ..... 70/26; 70/312

[58] Field of Search ..... 70/24–29, 22, 70/311, 312, 320–322

[56] References Cited

U.S. PATENT DOCUMENTS

| | | | |
|---|---|---|---|
| 2,830,447 | 4/1958 | Miller | 70/25 |
| 3,983,724 | 10/1976 | Foote | 70/25 |
| 4,048,821 | 9/1977 | Bako et al. | 70/25 |
| 4,123,923 | 11/1978 | Bako | 70/74 |
| 4,389,863 | 6/1983 | Bako | 70/312 |
| 4,621,509 | 11/1986 | Mizuno | 70/26 |
| 4,881,387 | 11/1989 | Kortenbrede | 70/39 |
| 4,987,753 | 1/1991 | Kuo | 70/39 |
| 5,092,142 | 3/1992 | Zane et al. | 70/39 |
| 5,119,282 | 6/1992 | Wang | 70/38 A |
| 5,142,888 | 9/1992 | Ling | 70/312 X |
| 5,406,811 | 4/1995 | Nakai | 70/26 |

*Primary Examiner*—Lloyd A. Gall
*Attorney, Agent, or Firm*—Bacon & Thomas

[57] ABSTRACT

A resettable combination coded U-shackle lock assembly includes a cross bar lock body and a U-shaped shackle with its legs removably locked to the lock body. The lock body is disposed with a resettable combination coded locking module, a locking plate, a triggering button, and a locking plate spring. The locking plate, through its locking holes, engages the locking pins of the shackle by the biasing force exerted by the locking plate spring and disengages when the triggering button disposed on the other end of the locking plate is depressed to overcome the biasing force and causing the locking plate to move axially to release engagement with the locking pins. When the combination code is coded in locking combination, the axial movement of the locking plate is blocked by the stopping plate of the locking module and the lock is in "locked" status. When the combination code is coded in an opening combination, the stopping plate of the locking module, biased by the stopping plate spring, returns to a normal position whereby ceases blocking action against the movement of the locking plate and the lock is in "unlocked" status. The shackle can then be removed from the lock body by depressing the triggering button.

7 Claims, 7 Drawing Sheets

RESETTABLE COMBINATION CODED U-SHACKLE LOCK

BACKGROUND OF THE INVENTION

1. Field of the Invention

The present invention relates to a U-shackle lock assembly and more particularly, to a resettable combination coded U-shackle lock assembly employing a resettable combination coded lock mechanism and resulting resettable combination code U-shackle lock in a unique lock set that is easy and convenient to use as well as to manufacture.

2. Description of Prior Art

The resettable combination coded locking mechanism has been well developed and widely applied to lock the related luggages. On the other hand, the vast majority of existing U-shackle locks that are used for locking bicycles and motorcycles employ traditional key operated locking modules.

The traditional key operated U-shackle locks have been in existence for a very long time and well developed. See U.S. Pat. No. 5,199,282; 5,092,142; 4,987,753 and 4,881,387. More recently U-shackle locks featuring combination coded locking system have been developed.

Mizuno (U.S. Pat. No. 4,621,509) disclosed a lock with combination coded mechanism attached to one end of the cross bar lock body. Aside from the shortcoming that it does not allow resetting of the combination code, the additional length of the lock along the axial direction of the lock body is an easy prey for the thieves since the thieves can simply slide a piece of hollow steel pipe tube outside of the coded lock portion and twist to take it apart from the rest of the lock and thus disabling the entire lock.

Nakai (U.S. Pat. No. 5,406,811) disclosed a lock that conceptually improved and avoided the shortcoming of Mizuno lock. However, the fact that it uses a long and slender "operating shaft" as the core of the entire lock makes it susceptible to internal misalignment of the several components in moving contact with the operating shaft. The internal misalignment may occur when shock forces are applied to the lock causing the operating shaft to deform. A common source of the shock forces is the hammering of lock by hammer-like objects.

The present invention provides an improved combination coded U-shackle lock assembly that uses a resettable combination coded locking module that can be manufactured and assembled as an independent unit and then integrated into the U-shackle lock assembly to form a complete lock. The combination coded locking module as an independent unit is essential in an application environment, such as locking bicycles, where the lock is constantly subject to shocks and vibrations. The delicate and precision-demanding combination lock assembly can best be protected against rough usage when it is built in a solid independent unit.

The resettable combination coded locking mechanism has been widely known. See U.S. Pat. Nos. 4,389,863; 4,123,923 and 4,048,821. Its reliability and ease of manufacturing has been time tested. Application of this module to the U-shackle lock assembly provides much reliability over the existing locks.

Summary of the Invention

It is an objective of this invention to provide a resettable combination coded U-shackle lock which effectively overcome some of the shortcomings of prior art devices and which is easier and more convenient to manipulate as well as being of sturdier and of more compact construction.

It is another objective of this invention to provide a resettable combination coded U-shackle lock with a modular-type construction wherein the dials, sleeves and the locking mechanism are built as an independent module that can be readily as well as efficiently integrated into the total lock system.

It is a further objective of this invention to provide a resettable combination coded U-shackle lock with a modular-type construction that will greatly reduce the manufacturing cost and sturdier against intentional destruction attempts.

More specifically, it is the objectives of the present invention to provide a locking device for bicycles and the like of the kind including a U-shaped shackle, formed with a pair of legs, a cooperating cross bar lock body adapted to lock across the ends of the U-shackle, and means for securing the both ends and featuring a resettable combination coded locking module mounted in one side of the cross bar lock body and in between the legs of the U-shackle when the lock is assembled. The means for securing the legs of the U-shackle is accomplished by a locking plate which also extends and projects through one end of the cross bar lock body and serves as triggering button that is to be used to control the engagement or disengagement of the U-shackle and the lock body. The linear displacement of the locking plate which controls the engagement or disengagement of the U-shackle and the lock body is further controlled by the stopping plate which is a part of the combination locking module and moves in a direction perpendicular to that of the locking plate and whose displacement is in turn controlled by the dials through the engagement of bushing sleeves.

In a combination coded U-shackle lock of the type described herein, the trigger button and the dials that are exposed to the exterior of the lock are most likely to receive shock forces intentionally or otherwise. Preferably, when a shock force is applied to one part of the lock the resulting damage will not propagate to other parts or the damage be limited or localized so that the performance of the entire lock will not be compromised. The arrangement to have an independent combination coded locking module with a stopping plate moving in a direction perpendicular to, and controlling, the motion of the locking plate is a great step toward localizing the damage caused by external forces.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
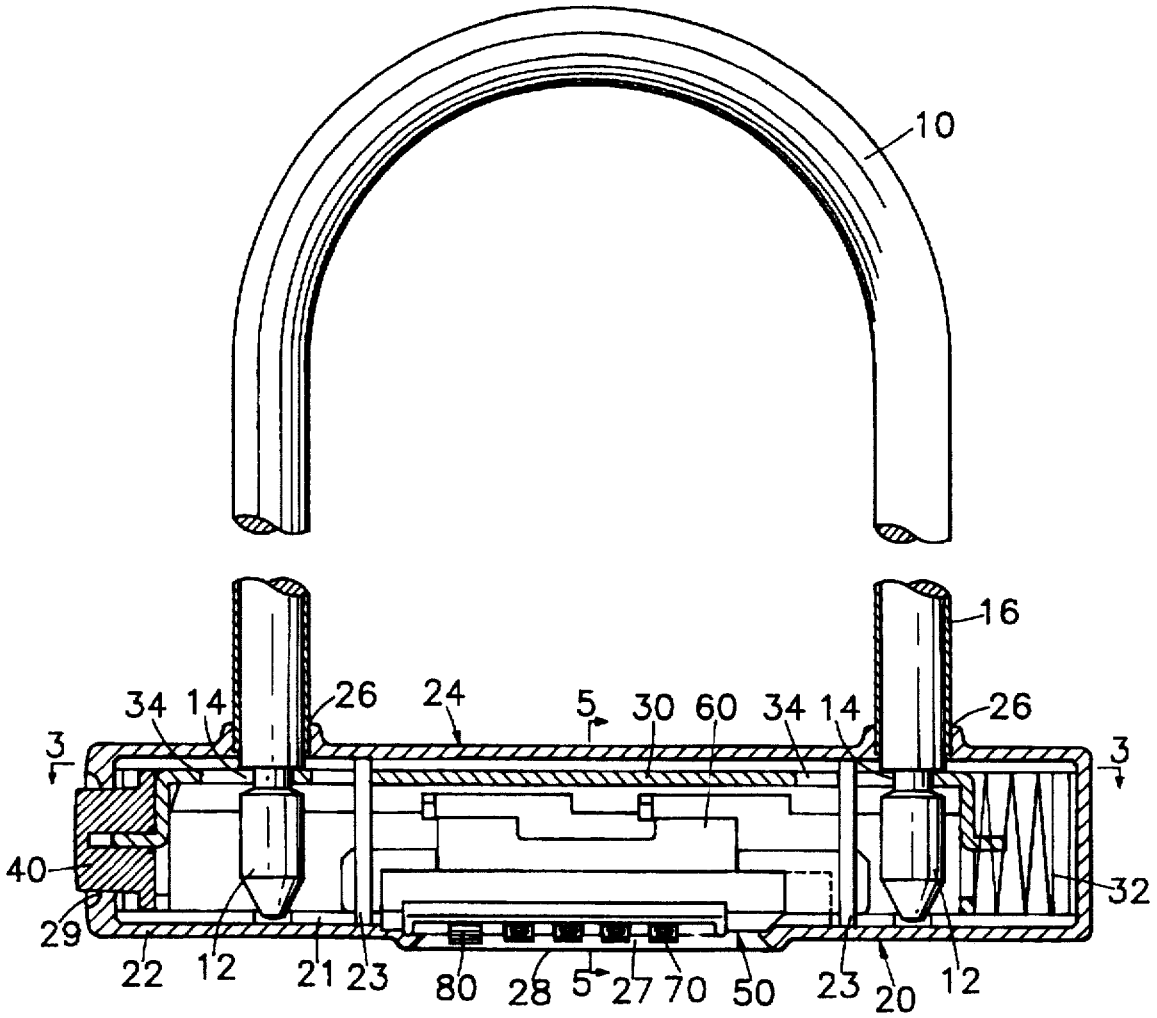
FIG. 1 is a longitudinal cross sectional view of the combination coded lock having a U-shape locking bolt which is in locked position.
Figure 2:
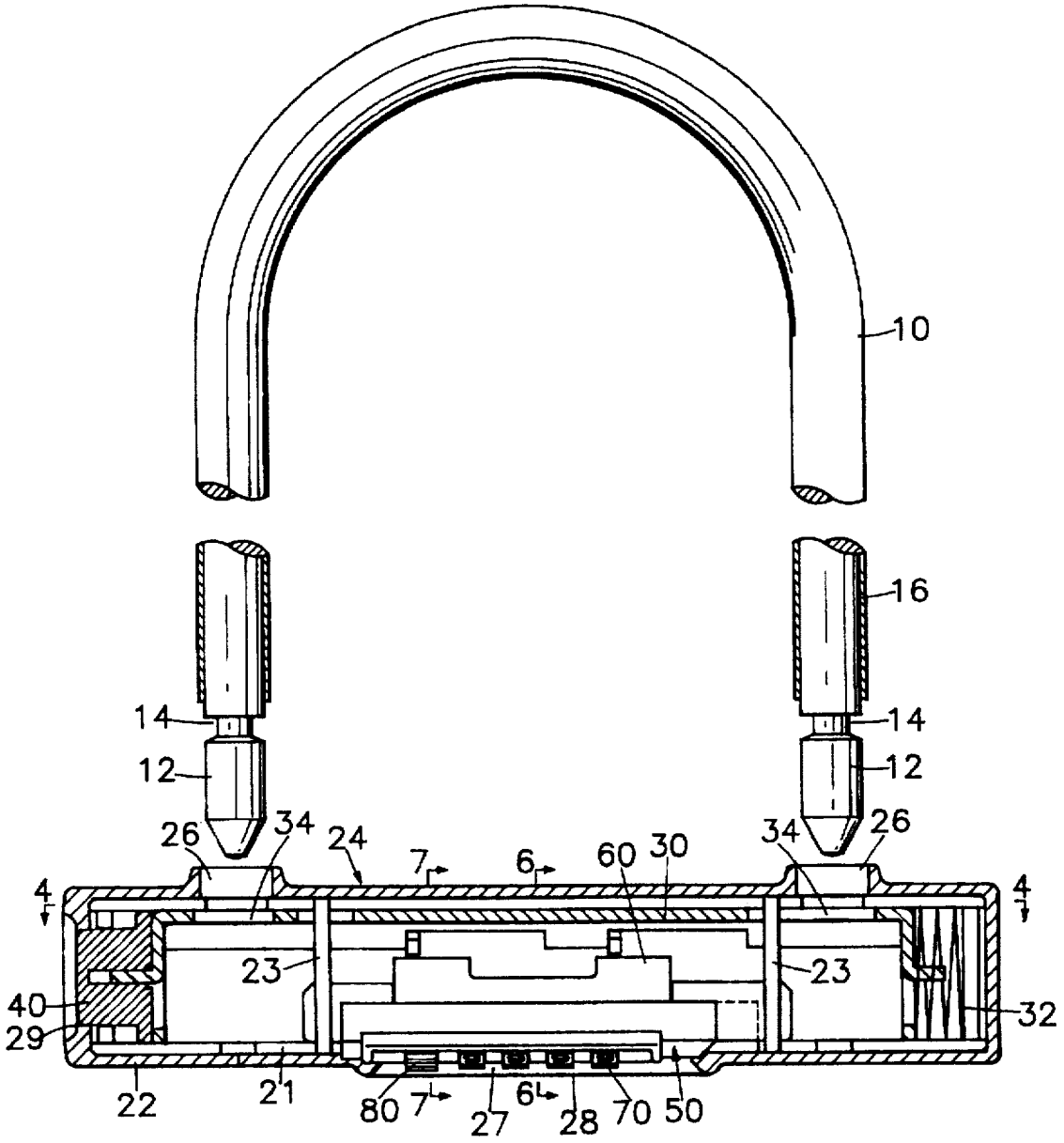
FIG. 2 is similar to FIG. 1 except the lock is in released position.

Referring to FIGS. 1 and 2, a combination coded lock assembly includes a U-shape shackle 10 and a cross bar lock body 20. The shackle 10 is made from rigid material, such as steel rod which has been enveloped or coated with a polyvinyl chloride coating 16. Both legs of the shackle 10 are formed with a cone-shape locking pin 12. A retaining groove 14 is formed above and spaced apart from the locking pin 12.

The cross bar lock body 20 includes a housing 24 having a metal bottom 21. The housing 24 is enclosed by a shell 22 which is sealed thereof by an ultrasonic wave weeding process. The top surface of the housing 24 is provided with a pair of openings 26 spaced apart such that the locking pin 12 can be readily received therein. The bottom surface of the housing 24 is provided with a rectangular opening 27 in which a plurality of dials 70 and a reset button 80 can projected out of the bottom surface via the rectangular opening 27. The side wall of the housing 24 is also provided with an opening 29 for a triggering button 40. The housing 24 further includes a protecting cover 28 adjacent to the rectangular opening 27 such that the rectangular opening 27 can be covered when the cover 28 is closed or uncovered when the cover 28 is opened. With this arrangement, the dials 70 and the reset button 80 can protected from being soiled by the accumulated dust. The dials 70 and the reset button 80 are therefore kept in good condition during its service life. In use, the protective cover 28 can be pivoted or removed therefrom such that the dials 70 and reset button 80 are uncovered, then the user may readily manipulate the dials 70 to release the shackle 10 or the reset button 80 for changing the codes preset by the dials 70.

The housing 24 is built-in with a locking plate 30 for engaging the locking pin 12. A triggering button 40 is also disposed at the opening 29 of the housing 24 and which is connected with the locking plate 30 at one end such that the locking plate 30 can be manipulated externally via the triggering button 40. The other end of the locking plate 30 is biased by a spring or locking plate spring 32. A combination coded locking module 50 is also built-in the housing 24 and which is used to control the engagement or disengagement between the locking plate 30 and the locking pin 12 via a stopping plate 60.

Figure 3:
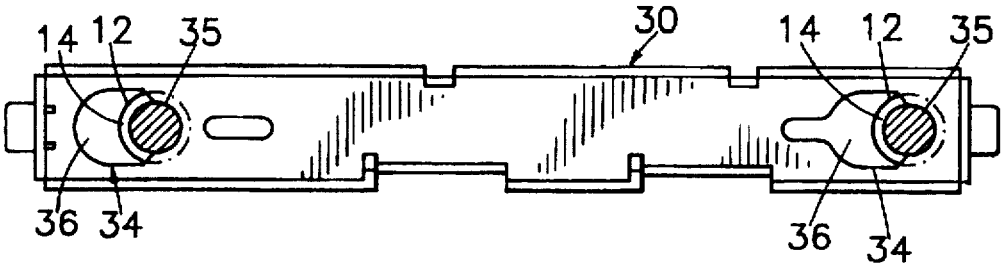
FIG. 3 is a partial cross sectional view taken from line 3—3 in FIG. 1, in which relative positions of the retaining tab and U-shape locking bolt is shown.
Figure 4:
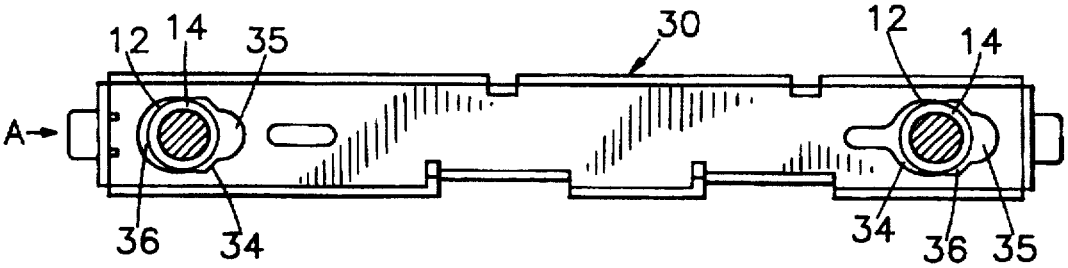
FIG. 4 is a partial cross sectional view taken from line 4—4 in FIG. 2, in which relative positions of the retaining tab and U-shape locking bolt is shown.

Referring to FIGS. 3 and 4, the locking plate 30 is provided with a twin holes 34 having a larger hole 36 which has a diameter larger than the outer diameter of the locking pin 12 and a small hole 35 which has a diameter between the outer diameter of the locking pin 12 and the outer diameter of the retaining groove 14. As shown in FIGS. 1 and 3, normally, the locking plate 30 is biased away from the locking plate spring 32, i.e. to left direction and toward the triggering button 40. In this situation, the small hole 35 of the twin hole 34 is inserted into the retaining groove 14 of the locking pin 12 such that the locking pin 12 is prevented from removing from the opening 26 of the housing 24. With this arrangement, the shackle 10 can not be separated from the cross bar lock body 20.

Referring to FIGS. 2 and 4, when each of the dials 70 is positioned at correct code and the locking plate 30 is released by the stopping plate 60, then when the triggering button 40 is pressed, the locking plate 30 can be moved to right (marked with arrow A in FIG. 4) and the locking plate spring 32 is compressed. In this situation, the small hole 35 of the twin hole 34 is removed from the retaining groove 14 and the larger hole 36 is now moved to the retaining groove 14. Accordingly, the locking pin 12 can be readily released from the larger hole 36 and the opening 26. In light of this, the shackle 10 can be released and separated from the cross bar lock body 20.

As mentioned above, the stopping plate 60 can be engaged or released by the locking module 50 and the details of the latter will be detailedly described through FIGS. 9 to 12. The locking module 50 includes a plurality of dials 70, a reset button 80 and its accessories and a stopping plate 60. These components can be integrally manufactured and assembled in modular manner within a casing composed by a panel bracket 51 and the frame cover 52. The panel bracket 51 and the frame cover 52 are fastened together by means of rivets or other suitable measures. The panel bracket 51 is provided with a plurality of windows 53 in which the dials 70 may protrude therefrom and finally projected out of the cross bar lock body 20 for manipulation of the user. The panel bracket 51 is provided with pin hole 57 at the side lug 58. A pair of fastening pins 23 can be applied to attach the locking module 50 adjacent to the rectangular opening 27 of the housing 24 via the pin holes 57, as clearly shown in FIGS. 1 and 9.

Figure 11:
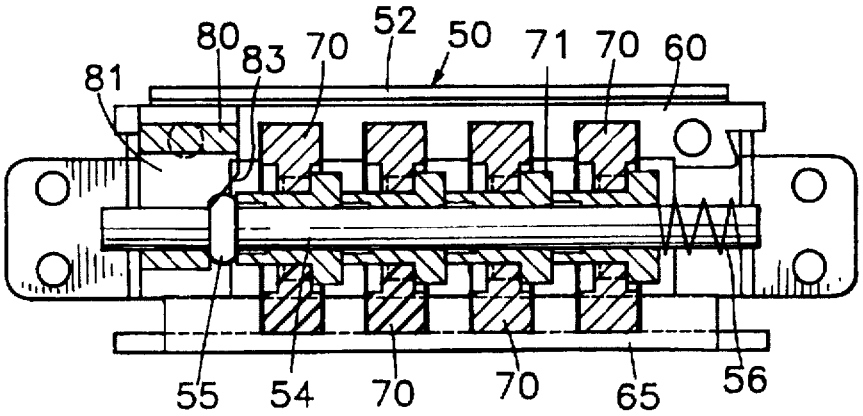
FIG. 11 is a cross sectional view taken from line 11—11 of FIG. 9.

As shown in FIG. 11, a shaft 54 having an annular flange 55 is horizontally installed on the frame cover 52. A plurality of dials 70 are installed on the shaft 54 at the other side of annular flange 55. Each of the dials 70 is inscribed equiangularly with numbers, i.e. 0, 1, 2, . . . , 9, at the rim portion. The inner rim of each of the dials 70 is removably engaged with a respective sleeve 71 which is moveable on the shaft 54 along one direction. Those sleeves 71 are disposed adjacent to each other in serial. One end of those sleeves 71 is limited by the annular flange 55. The other end of the sleeves 71 is biased by a spring or sleeve spring 56. Accordingly, each of the sleeves 71 is pressed against the respective dial 70. When the dial 70 is rotated as an external force is applied, the sleeves 71 is moved synchronically, as shown in FIG. 11.

The locking module 50 further comprises a reset button 80 and a stopping plate 60 to limit the movement of the locking plate 30.

Figure 5:
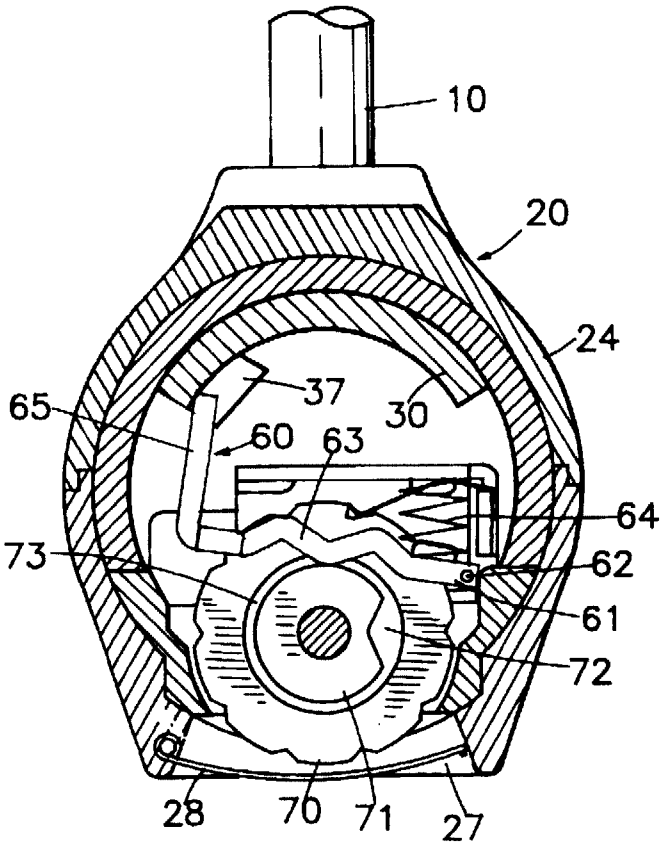
FIG. 5 is a partial cross sectional view taken from line 5—5 in FIG. 1, in which the relative positions of dial, sleeve, stopping plate and retaining tab under the locked position is shown.
Figure 6:
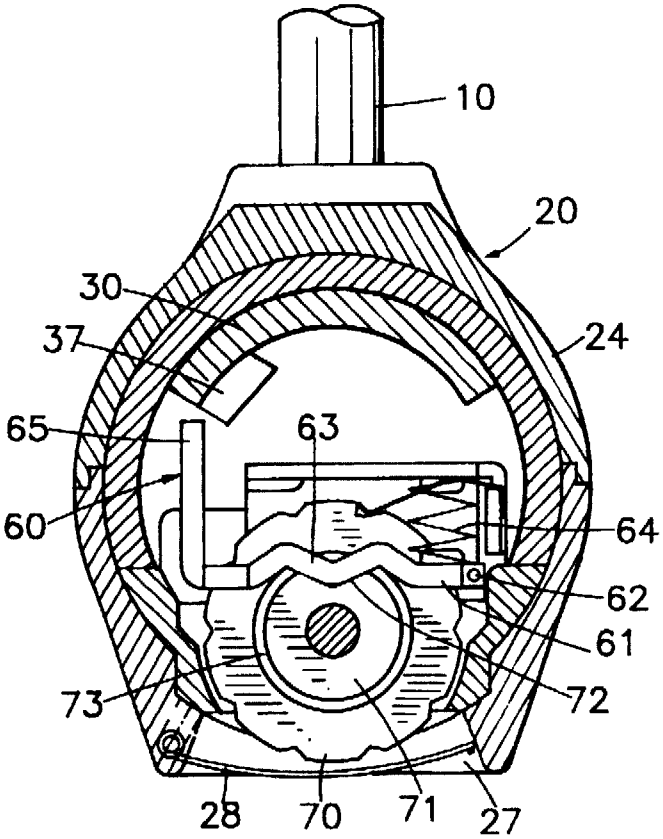
FIG. 6 is a partial cross sectional view taken from line 6—6 in FIG. 2, in which the relative positions of dial, sleeve, stopping plate and retaining tab under the released position is shown.

Referring to FIGS. 5 and 6, the stopping plate 60 has an L-shape configuration and is pivotally attached to the frame cover 52 or panel bracket 51 with both ends of one side portion. Accordingly, the stopping plate 60 can be pivoted as centered on the pivoting side portion 62. The stopping plate 60 includes a planar bottom 61 having a plurality of projected flanges 63 thereof. Each of the sleeves 71 is provided with a cutout 72 such that the sleeves 71 is independent to the stopping plate 60 when the cutout 72 is aligned with the projected flange 63.

As shown in FIG. 6, when the dials 70 are rotated externally from the lock body 20 and are positioned at correct codes, each of the corresponding sleeves 71 is also moved to a position in which the cutout 72 is aligned with the projected flange 63. In this case, a stopping plate spring 64 can be pushed such that the stopping plate 60 is pivoted to horizontal position. As a result, the erect supporting leg 65 of the stopping plate 60 is moved to a position lowered than the lowest position of the extending flange 37. With this arrangement, the locking plate 30 will not be engaged or stopped by the stopping plate 60, referring to FIGS. 2 and 4. Since each and every dials 70 is moved to correct code, when the triggering button 40 is depressed, the locking plate 30 is moved accordingly. As a result, the larger hole 36 of the twin hole 34 will move to the retaining groove 14 such that the shackle 10 can be removed from the lock body 20.

As shown in FIG. 5, when the user hopes to lock the bicycle or motorcycle with the shackle 10 and the lock body 20, he/she may simply insert the locking pin 12 through the openings 26 such that the retaining groove 14 will be retained by the small hole 35 as the locking plate 30 is continuously biased by the locking plate spring 32. Afterward, the dials 70 can be randomly rotated such that the codes is encoded. In this case, the cutout 72 of the sleeves 71 will misalign with the projected flange 63 of the stopping plate 60. In this case, the projected flange 63 of the stopping plate 60 can be pushed by the portion of the sleeves 71 except the cutout 72, then the stopping plate 60 is pivoted upward into a tilted position as centered on the pivoting side portion 62. As a result, the erect leg 65 of the stopping plate 60 is moved from the lowest position into a highest position such that the extending flange 37 of the locking plate 30 is engaged by the erected leg 65. With this arrangement, the locking plate 30 is blocked without any axial movement, as shown in FIGS. 1 and 3. In this case, the small hole 35 of the twin hole 34 is again engaged with the retaining groove 14 of the locking pin 12 and the latter is prevented from moving out of the lock body 20. In this case, the bicycle or motorcycle locked is well protected since the shackle 10 is fixedly locked within the lock body 20.

Figure 8:
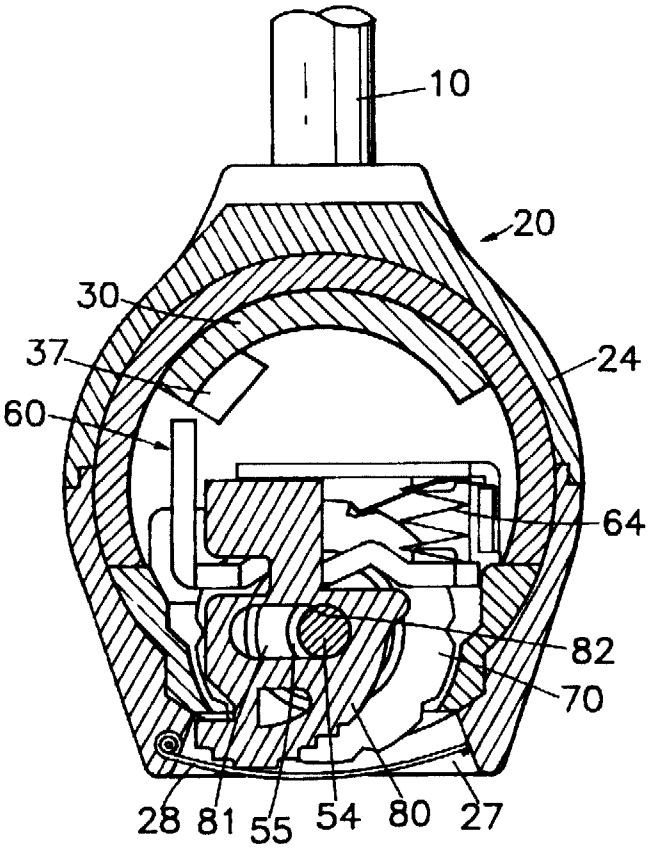
FIG. 8 is similar to FIG. 7 in which the reset button is positioned at setting position and the relation between the shaft of the dials is shown.
Figure 7:
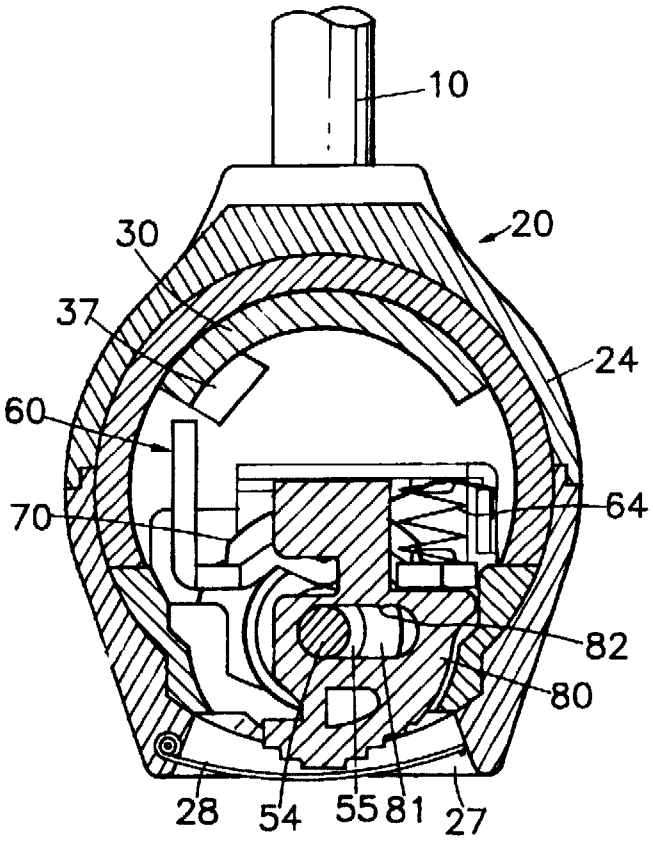
FIG. 7 is a cross sectional view taken from line 7—7 of FIG. 2, in which the reset button is positioned at normal position and the relation between the shaft of the dials is shown.
Figure 9:
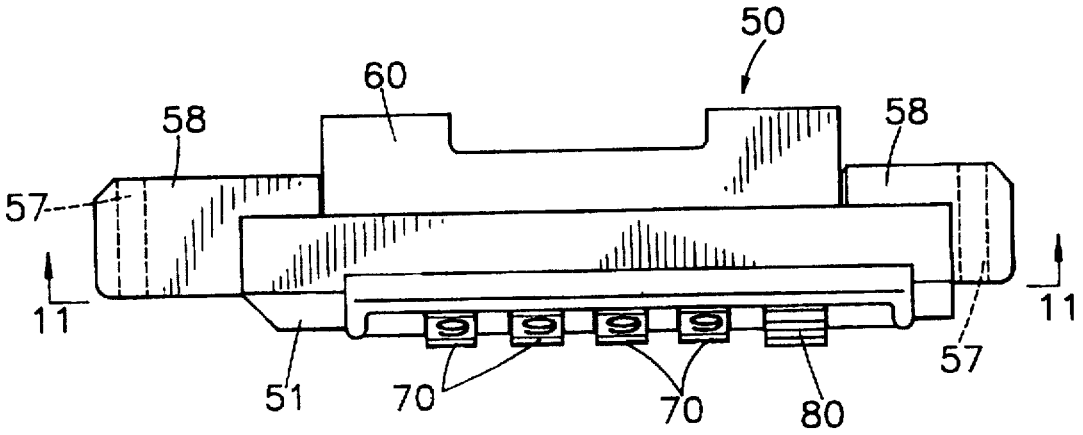
FIG. 9 is a front view of the modular locking cylinder of the combination coded lock having a U-shape locking bolt.
Figure 10:
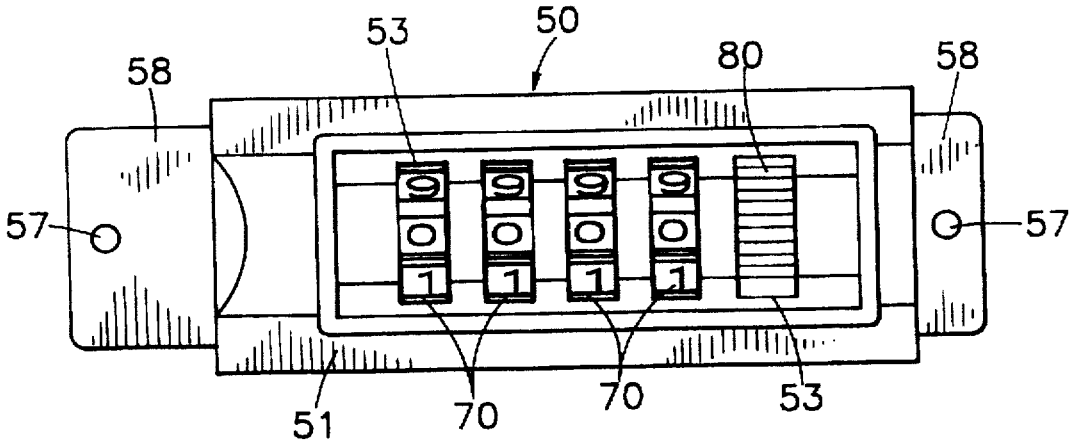
FIG. 10 is a bottom view of the modular locking module.

Referring to FIGS. 7 and 8, the reset button 80 is provided with an elongate slot 81 in which the shaft 54 may pass through. The side wall of the elongate slot 81 is provided with at least a positioning boss 82. When the reset button 80 is moved axially along the shaft 54, the reset button 80 can be readily positioned at a normal position by means of the positioning boss 82 respectively, as clearly shown in FIG. 11 and 12. Normally, the reset button 80 is positioned at normal position in which each of the dials 70 is removably engaged with the corresponding sleeve 71 as the latter are biased by the sleeve spring 56. Accordingly, the dial 70 is moved synchronically with the corresponding sleeve 71.

Figure 12:
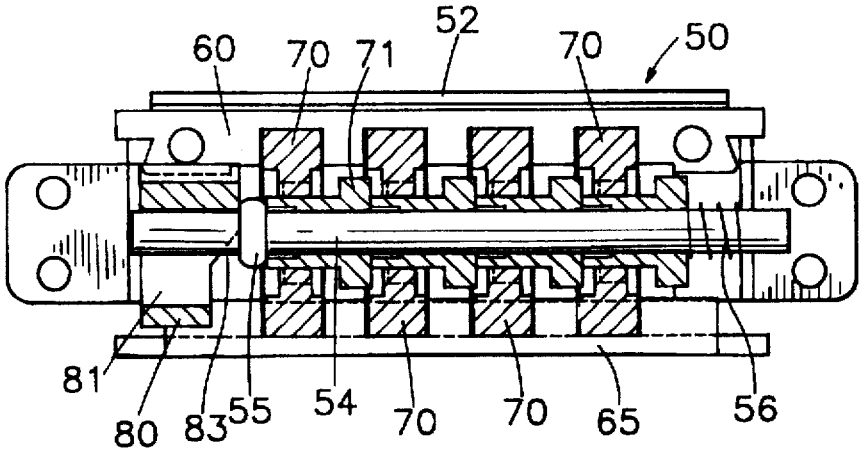
FIG. 12 is similar to FIG. 11 except the reset button is positioned at setting position and the dial is separated from the sleeve.

When the user needs to change the codes, the reset button 80 can be moved and positioned at the setting position when the reset button 80 is moved externally from the housing 24. In this setting position, the inclined surface 83 of the reset button 80 is biased against the annular flange 55 of the shaft 54 such that the shaft 54 is moved toward the sleeve spring 56. Meanwhile, each of the sleeves 71 is also moved by the annular flange 55 of the shaft 54 to overcome the biasing force from the sleeve spring 56. As a result, the dial 70 is disengaged with the corresponding sleeve 71, as shown in FIG. 12. In this situation, each of the dials 70 can be freely rotated independently from the corresponding sleeves 71 to change the code to be represented by each dial 70, i.e. the cutout 72 of the sleeves 71 corresponding to the numbers inscribed on the outer rim of the dial 70 is changed accordingly. When the desired codes are selected, the reset button 80 can be returned to the original normal position such that the dial 70 is engaged with the sleeve 71 again as biased by the spring 56, clearly shown in FIG. 11. Afterward, the locking module 50 can only be decoded by the newly set codes.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

What is claimed is:

1. A resettable combination coded U-shackle lock assembly, comprising (a) a U-shaped shackle having a pair of legs, a cone-shaped locking pin provided at the end of each said legs in which a retaining groove is provided at an upper portion of each said locking pin;

(b) a cross bar lock body being used to lock said pair of legs across open ends of said shackle, including:

(1) a housing having a pair of openings at a top surface for receiving said locking pins of said U-shaped shackle and a rectangular opening at a middle bottom portion of said housing;

(2) a locking plate slidably mounted in an upper portion of said housing having a pair of holes corresponding to said locking pins, one end of said locking plate being biased by an axial force from a locking plate spring such that smaller hole portions of said holes are engaged with said retaining grooves of said locking pins to lock up said U-shaped shackle, the other end of said locking plate being connected with a triggering button such that the engagement between said smaller hole portions and said retaining grooves are released when said triggering button is depressed; and (3) an integrally manufactured combination coded locking module provided inside said rectangular opening at the middle bottom portion of said housing, said locking module including a reset button for resetting the combination codes, a plurality of dials accompanying bushing sleeves and a stopping plate for controlling the movement of said locking plate, wherein when said dials are randomly disposed and the code is in locking combination, said stopping plate will be in blocking position such that said locking plate is blocked from axial movement to release said locking pins, wherein when said dials are disposed at the code of opening combination, said stopping plate is returned to a normal position by a stopping plate spring such that said locking plate is free for axial movement, then said triggering button is to be depressed to release the engagement between said smaller hole portions of said holes of said locking plate and said retaining grooves of said locking pins;

(4) means for securing said locking plate and said combination coded locking module within said housing of said cross bar lock body.

2. A resettable combination coded U-shackle lock assembly recited in claim 1, wherein said U-shaped shackle is covered by plastic skin.

3. A resettable combination coded U-shackle lock assembly recited in claim 1, wherein said cross bar lock body is covered by plastic casing.

4. A resettable combination coded U-shackle lock assembly recited in claim 1, wherein the bottom of said housing being further provided with a protecting cover adjacent to said rectangular opening.

5. A resettable combination coded U-shackle lock assembly as recited in claim 1, wherein said locking module comprises a casing configured by a panel bracket and a frame cover;

a shaft having an annular flange being horizontally installed on said frame cover;

the plurality of dials being rotationally installed on said shaft adjacent to said annular flange, the inner rim of each of said dials being removably engaged with a respective bushing sleeve moveable on said shaft along one direction, one end of said bushing sleeves set being limited by said annular flange and the other end of said bushing sleeves set being biased by a sleeve spring such that said dials are removably engaged with said sleeve set along said shaft, each of said bushing sleeves being provided with a cutout at an outer rim; and the stopping plate having an L-shape configuration being pivotally fixed to said casing with a side portion of the bottom of said stopping plate such that said stopping plate may perform a pivotal movement as centered on said side portion, the bottom of said stopping plate being provided with a plurality of projected flanges, wherein when said dials are turned to opening positions, said cutout of said sleeves is aligned with said projected flanges of said stopping plate which is then pivoted into a horizontal position as biased by said stopping plate spring and in which an erect legs of said stopping plate is moved to a normal position and said locking plate is free for axial movement, wherein when said dials are positioned in locking position, said cutout of said sleeves is misaligned with said projected flanges such that said stopping plate is forced to a tilted position in which said erect leg is moved to locking position to engage with said locking plate to block it from axial movement.

6. A resettable combination coded U-shackle lock assembly as recited in claim 5, wherein the panel bracket of said locking module is provided with a plurality of openings such that said dials and said reset button is projected over said housing through said openings, two side surfaces of said panel bracket being provided with side lug which have a pin hole thereof, and a pair of fastening pins is applied to attach said locking module adjacent to the rectangular opening of the housing via said pin holes.

7. A resettable combination coded U-shackle lock assembly as recited in claim 5, wherein said reset button is disposed externally of said housing, said reset button includes an elongate slot in which said shaft may pass through, the side wall of said elongate slot being provided with at least a positioning boss which is positioned between a normal position and a setting position, said reset button further includes an inclined surface which is disengaged with the shaft under normal condition, when said reset button is set to setting position, said inclined surface may bias against said annular flange of said shaft such that the shaft is moved toward said sleeve spring, meanwhile, each of said sleeves is also moved by said annular flange of the shaft to overcome the biasing force from the sleeve spring, as a result, said dial is disengaged with the corresponding sleeves.

* * * * *